United States Patent [19]

Ohringer

[11] 3,964,466

[45] June 22, 1976

[54] PARALLEL FLUID HEATING SYSTEM

[76] Inventor: Jack G. Ohringer, 175 Rodgers, Vallejo, Calif. 94590

[22] Filed: Mar. 31, 1975

[21] Appl. No.: 563,910

[52] U.S. Cl. ..... 126/361; 126/374; 137/113; 122/448 B; 236/1 E; 236/20 R

[51] Int. Cl.[2] ..... F24H 1/00

[58] Field of Search ..... 236/1 E, 20; 126/374, 126/361, 362; 137/113; 122/448 B

[56] References Cited

UNITED STATES PATENTS

| | | | |
|---|---|---|---|
| 2,083,612 | 6/1937 | Midyette, Jr. | 236/1 E |
| 2,780,206 | 2/1957 | La Rocque et al. | 122/448 B |
| 3,461,854 | 8/1969 | Toni et al. | 126/362 |
| 3,684,169 | 8/1972 | Clinton | 236/20 |

*Primary Examiner*—Kenneth W. Sprague
*Assistant Examiner*—Larry I. Schwartz
*Attorney, Agent, or Firm*—R. S. Sciascia; Charles D. B. Curry

[57] ABSTRACT

A parallel water heating system having a plurality of water heaters supplying heated water to a plurality of water consuming loads. The water consuming outlet conduit from each of the water heaters includes a temperature responsive control valve that controls the flow rate of hot water from that particular heater to the various parallel connected loads. Each of these control valves is selected to be fully open when the water temperature is above an upper predetermined value and fully closed when below a lower predetermined value. Between the upper and lower predetermined values the valve preferably varies from fully open to fully closed by an amount that is about linearly proportional to the decrease in temperature.

7 Claims, 2 Drawing Figures

PARALLEL FLUID HEATING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to a parallel fluid heating system and more particularly to a parallel fluid heating system that employs a plurality of fluid temperature responsive flow control valves at the outlet of each of the heaters.

2. Description of the Prior Art

Fluid heating systems in general and hot water heating systems in particular have had very little new development over the last several decades. It is well known to those skilled in the art to connect water heaters in parallel to supply hot water to various water consuming loads. Such systems have been used on naval ships, for example, where the consuming loads may be the laundry, scullery, officers' wash rooms, crews' wash rooms and the like.

Several difficulties have been encountered with these parallel water heating systems. One of these difficulties is that most of the water drawn by a given load is from the nearest water heater irrespective of its outlet water temperature. This is because the piping pressure drop from the load to the nearest heater is smaller than to the other more remote heaters. Therefore, when load demands become large the water temperature to that particular load may drop to a temperature that is considerably below the outlet water temperatures of the other more remote water heaters. Another difficulty with conventional parallel water heater systems is that if one of the heaters fails to heat the water adequately, the cold water it supplies will cool down the water supplied by the other heaters to the load. Still another difficulty encountered with the conventional parallel water heating systems is that if a pipe is ruptured between the heaters and the load there will be a continuous supply of water by the heaters to that rupture.

In accordance with the present invention these difficulties are overcome by employing a plurality of water temperature responsive flow control valves at the outlet of the heaters.

SUMMARY OF THE INVENTION

Briefly, the present invention comprises a parallel water heating system having a plurality of water heaters supplying heated water to a plurality of water consuming loads. The water consuming outlet condult from each of the water heaters includes a temperature responsive control valve that controls the flow rate of hot water from that particular heater to the various parallel connected loads. Each of these control valves is selected to be fully open when the water temperature is above an upper predetermined value and fully closed when below a lower predetermined value. Between the upper and lower predetermined values the valve preferably varies from fully open to fully closed by an amount that is about linearly proportional to the decrease in temperature.

In another embodiment of the parallel fluid heating system of the present invention a separate by-pass valve is connected between the heaters and the loads. This valve is fully closed when any of the temperature responsive control valves are open and is fully opened when all of the temperature responsive control valves are closed.

STATEMENT OF THE OBJECTS OF THE INVENTION

An object of the present invention is to provide a parallel fluid heating system that provides the highest possible flow rate from the heaters having the highest outlet temperatures.

Another object of the present invention is to provide a parallel fluid heating system that minimizes the system cooling effect when one of the heaters fails to provide sufficiently hot fluid.

Still another object of the present invention is to provide a parallel fluid heating system that temporarily shuts down when there is a rupture in the system between the heaters and the consuming load or loads.

A further object of the present invention is to provide a parallel fluid heating system that is reliable, inexpensive and provides optimum performance.

A still further object of the present invention is to provide a parallel fluid heating system that employs a fluid temperature responsive control valve at the outlet of each of the heaters used in the system.

Other objects, advantages and novel features of the present invention will become apparent from the following detailed description of the invention when considered in conjunction with the accompanying drawings wherein:

DESCRIPTION OF THE PREFERRED EMBODIMENT

Figure 1:
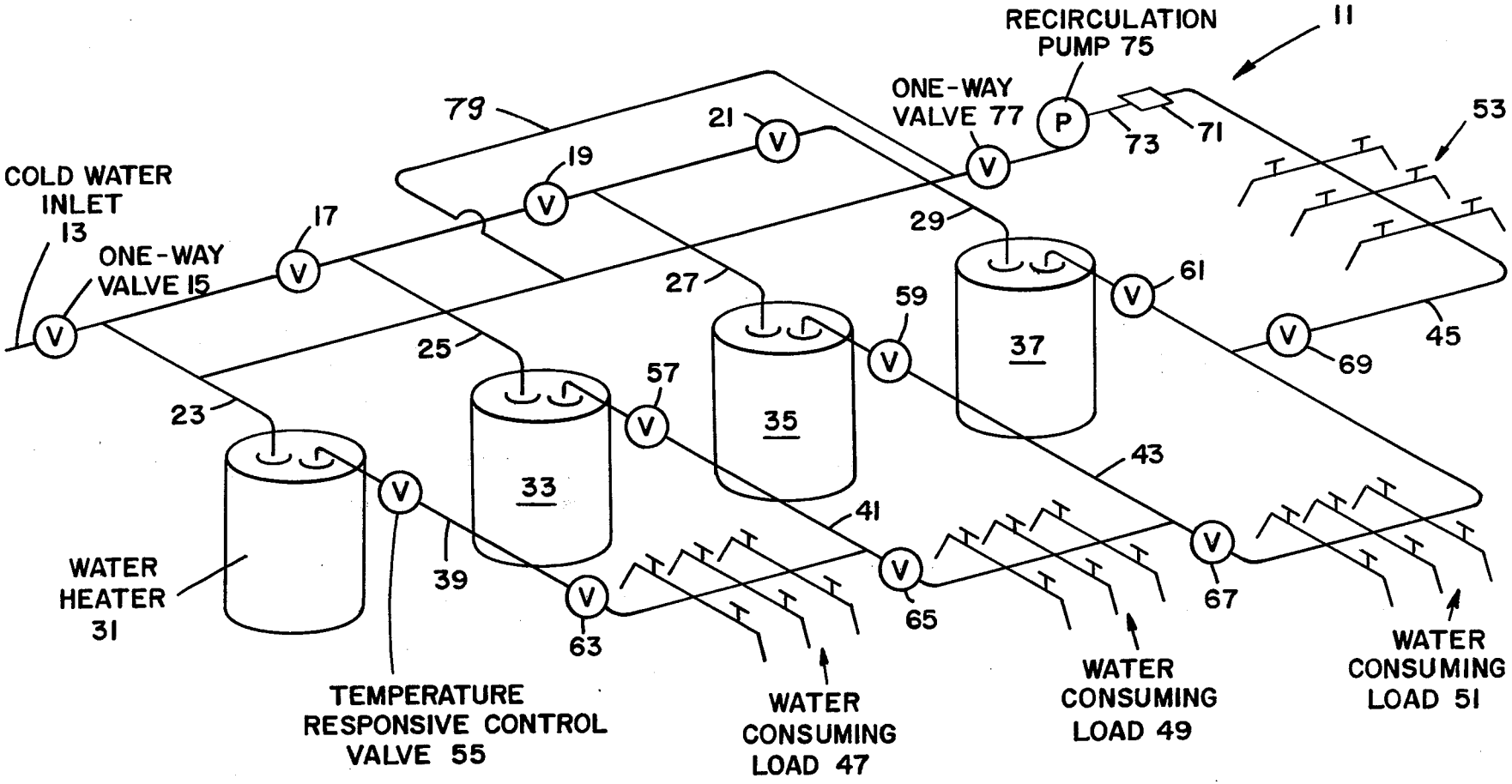
FIG. 1 is a schematic diagram of one embodiment of the parallel fluid heating system of the present invention.

In FIG. 1 is illustrated one embodiment of the parallel fluid heating system 11 of the present invention. At the outset it should be noted that since the system is intended to be used primarily to heat and supply water, it will be described in terms of water as the heated fluid. However, it will be understood that the system may be used to heat and supply fluids other than water, provided the use of such other fluid is compatible with the intended function of the system of the present invention.

The parallel heating system 11 of FIG. 1 includes cold water inlet conduit 13 that supplies cold water through one-way valves 15, 17, 19 and 21. The outlets of each of one-way valves 15, 17, 19 and 21 are respectively connected by conduits 23, 25, 27 and 29 to the inlets of water heaters 31, 33, 35 and 37, respectively. The hot water from hot water heaters 31, 33, 35 and 37 is respectively supplied through hot water conduits 39, 41, 43 and 45 to a plurality of hot water consuming loads 47, 49, 51 and 53 which may be showers, sinks, kitchen facilities and the like. Disposed near the outlets of the hot water heaters and in conduits 39, 41, 43 and 45 are temperature responsive control valves 55, 57, 59 and 61, respectively. These temperature responsive control valves are responsive to the temperature of the outlet water from the respective water heaters and control the flow rate therefrom in accordance with the present invention and as described below.

Each of hot water conduits 39, 41, 43 and 45 contain isolation valves 63, 65, 67 and 69, respectively. The outlet of hot water conduit 45 is connected through reducer 71 and a relatively small conduit 73 to the input of recirculation pump 75. The output of recirculation pump 75 is connected through one-way valve 77 and recirculation conduit 79 to the inlets of water heaters 31, 33, 35 and 37.

Each of temperature responsive control valves 55, 57, 59 and 61 are selected to be fully open when the water temperature is above about 130°F and fully closed, except for a very small flow rate to allow water temperature sensing, when the water temperature is about 105°F. Between 105° and 130°F the valve preferably varies from fully closed to fully open by an amount that is about linearly proportional to the increase in temperature. An alternative mode of operation is to have each temperature responsive control valve vary from fully closed to fully open by an amount that increases about exponentially with an increase in fluid temperature from 105° to 130°F. This provides for greater temperature differential and heat exchange in the hot water heaters. The particular construction and operation of temperature responsive control valves of this type are well known to those skilled in the art and will therefore not be described in detail. It will be understood that the 105° to 130°F temperature range is a temperature range that has been formed to be particularly effective for the parallel hot water system of the present invention. However, it will be understood that other temperature ranges may be employed depending upon the particular needs of the consuming loads, the temperature limits and capacity of the heaters, and the particular fluids being supplied.

From the foregoing description it can be seen that each of the four heaters 31, 33, 35 and 37 are connected in parallel to the four water consuming loads 47, 49, 51 and 53 which are also connected in parallel. It will be understood that, depending upon the particular needs, more or less heaters and loads may be added to or taken away from the parallel fluid heating system of the present invention. In parallel systems of this type it can also be seen that all four heaters will simultaneously supply water to one or more loads that are consuming water. However in accordance with the present invention, temperature responsive control valves 55, 57, 59 and 61 will regulate the flow of hot water from the various heaters 31, 33, 35 and 37 to achieve optimum system operation as hereinafter described.

In order to more fully understand the present invention the operation of a conventional system will be first described followed by a detailed description of the operation of the parallel water heating system 11 of the present invention. First assume there are no temperature responsive control valves 55, 57, 59 and 61 in the system, as in conventional systems, and load 53, for example, is consuming a large quantity of water. In this situation most of the water is drawn by load 53 from heater 37, a lesser amount from heater 35, a still lesser amount from heater 33 and the least amount from heater 31. This is due to different frictional pipe losses due to different pipe lengths. The reverse of this situation will be the case if load 47 is consuming hot water and the other loads are not. When load 53 consumes a large quantity of water, which is at a rate from heater 37 that is more than maximum temperature supply rate of heater 37, then the water temperature at the outlet of heater 37 will start dropping and the water temperature to the load will start to drop. This is the case even though the water temperatures from heaters 31, 33 and 35 are still at maximum value. When the hot water demand by load 53 becomes very excessive over a substantial period of time or heater 37 malfunctions then the water temperature from heater 37 will become very low, for example 50°F, and will therefore substantially cool the water to the load where it drops to a point where it is undersirable or unusable. Therefore, load 53 must be shut down to allow heater 37 to regenerate to a sufficiently elevated outlet temperature. The above conditions may prevail even though heaters 31, 33 and 35 have acceptable temperature levels. In certain situations the demand by load 53 may become so excessive that heaters 33, 35 and 37 will all drop below the acceptable temperature level and leaving only heater 31 providing water at an acceptable temperature level. However, since it provides water to the load at lesser flow rate than heaters 33, 35 and 37, due to its higher pipe resistances, the water temperature to load 53 will still be far below an acceptable level.

The object of the present invention is to supply water under these above described circumstances to the consuming load or loads at acceptable temperature levels by selectively choosing the appropriate water heater or heaters from which to obtain water. This is achieved by using temperature responsive control valves 55, 57, 59 and 61 at the outlets of water heaters 31, 33, 35 and 37. Each of the temperature responsive control valves 55, 57, 59 and 61 are selected to be fully open when the water temperature is above about 130°F and fully closed, except for a very small flow rate to allow water temperature sensing, when the water temperature is about 105°F. Between 105° and 130°F the valve preferably varies from fully closed to fully open by an amount that is about linearly proportional to the increase in temperature.

When no load is consuming water and the cold water supply upstream of one-way valve 15 is at 100 psi, for example, then the inlet pressure to recirculation pump 75 will be about 100 psi, and the pump will increase the pressure by 5 psi, for example, where the inlet pressure to each of the heaters 31, 33, 35 and 37 will be about 105 psi. One-way valves 15, 17, 19 and 21 prevent hot water from flowing back into the cold water supply line 13. Therefore, hot water will be continuously recirculated through heaters 31, 33, 35 and 37, conduits 39, 41, 43 and 45, conduit 73, recirculation pump 75 and conduit 79. The pressure drop through the system from the outlet of recirculation pump 75 back to the inlet of recirculation pump 75 will be about 5 psi. Therefore, hot water is continuously available to all of the loads upon demand.

In accordance with the present invention when load 53, for example, starts using hot water, the greater flow will come from heater 37 until its outlet temperature starts to drop below 130°F. When this happens then temperature responsive control valve 61 senses this temperature drop and shuts the valve down some so that load 53 starts to draw less from heater 37 and more from heaters 31, 33 and 35 which are still at their maximum temperatures. As load 53 continues drawing more hot water from the heaters then valve 61 will shut down some more and valve 59 will start shutting down. As more water is drawn, valves 61 and 59 shut down more and valve 57 will start shutting down. When this condition prevails then the maximum amount of hot water will be coming from heater 31, even though the line pressure drop to heater 31 is the greatest, since valve 55 is still wide open. As the demand by load 53 continues all of temperature responsive valves 55, 57, 59 and 61 will be at varying degrees of closure, and one or more may be fully closed. However, it should be particularly noted that the temperature responsive control valve that is most open, and supplying the most water, is connected to the heater supplying the hottest water. In this manner the consuming load will be receiving the hottest available water and the system is performing in the optimum manner.

As different loads are switched on and off at different times, for different time durations, and for different flow rates the analysis becomes highly complex. However, regardless of how complex the water loading may become the system still provides the most water from the heaters supplying the hottest water. It should be noted that as more and more water is continuously consumed by the loads, that all of temperature responsive control valves 55, 57, 59 and 61 may become completely shut down and will open only as the various heaters recover. This is generally an undesirable situation and the system is preferably designed, knowing anticipated loads and the heater supply rates, to prevent this from occuring. However, this condition may be overcome by providing a minimum flow rate, through valves 55, 57, 59 and 61 when fully closed, that is sufficient to provide for any anticipated load even though the water temperature is below 105°F.

Figure 2:
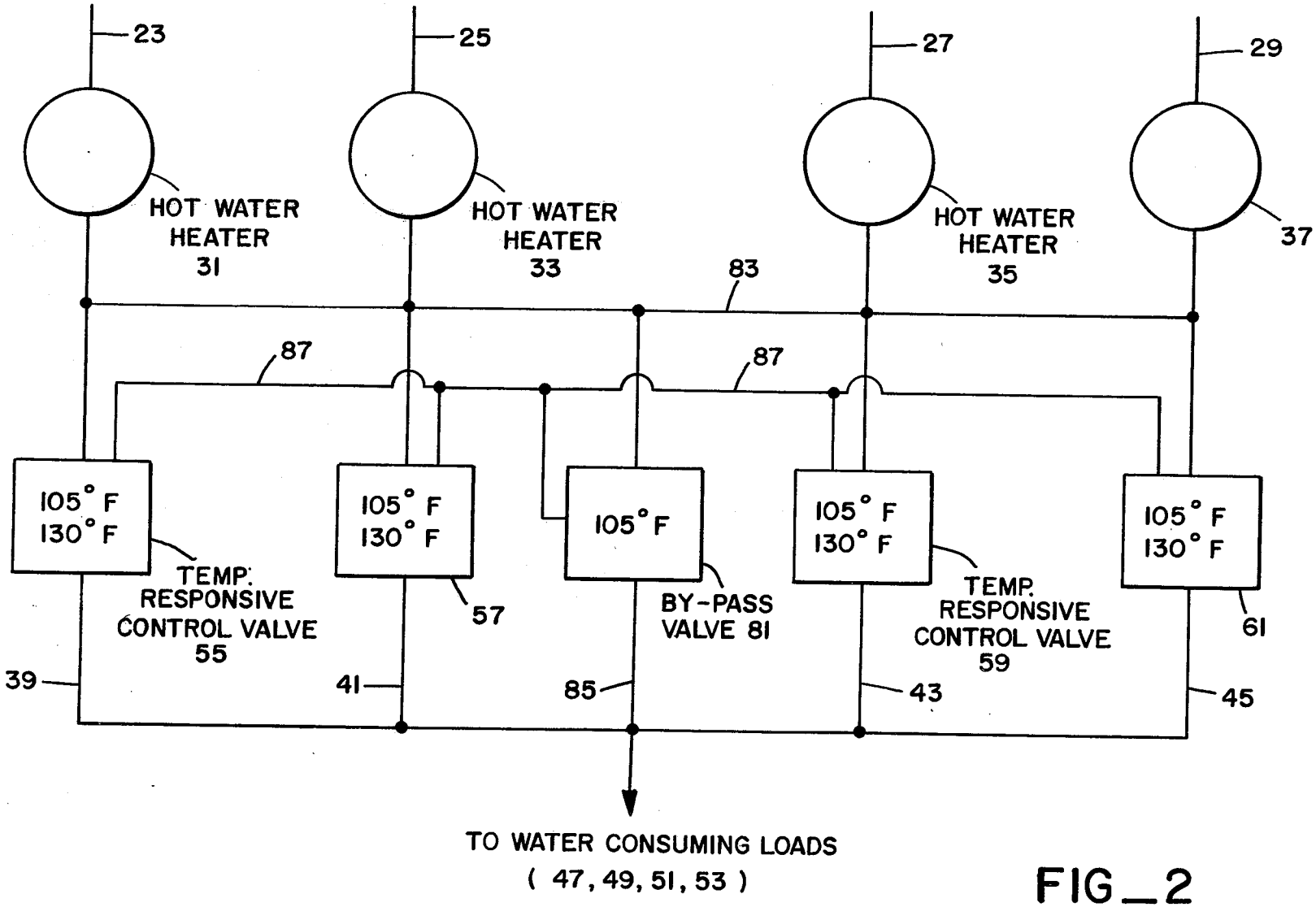
FIG. 2 is a schematic diagram of another embodiment of the parallel fluid heating system of the present invention.

In FIG. 2 is illustrated another embodiment of the present invention which permits maximum flow from heaters 31, 33, 35 and 37 even though all of temperature responsive control valves 55, 57, 59 and 61 are fully closed, except for a very small flow to permit temperature sensing. This embodiment of the present invention includes a by-pass valve 81 that opens when the water temperature to all of valves 55, 57, 59 and 61 is below 105°F and closes when the water temperature is above 105°F. The inlet of valve 81 is connected by conduit 83 to the outlet of each of heaters 31, 33, 35 and 37. The outlet of valve 81 is connected by conduit 85 to all of the water consuming loads 47, 49, 51 and 53.

It should be noted that the construction and operation of temperature responsive control valve 81 is well known to those skilled in the art and will therefore not be described in detail. The control of valve 81 is preferably responsive to the closure of all of valves 55, 57, 59 and 61 rather than to the temperature of the inlet water thereto. This may be achieved by an electric control system wherein each of valves 55, 57, 59 and 61 provide an electrical signal that is supplied to the control element of valve 81 by electrical lines 87 when they are open by any amount and no signal when they are fully closed. The control mechanism of valve 81 is selected to fully open valve 81 when there is no input signal and to fully close valve 81 when there is an electrical input signal from any of valves 55, 57, 59 and 61. Therefore, valve 81 remains closed when any of valves 55, 57, 59 and 61 are open and opens when all of valves 55, 57, 59 and 61 are closed.

The operation of temperature responsive control valves 55, 57, 59 and 61 of FIG. 2 is the same as previously described in the FIG. 1 embodiment. However, from the above it can be seen that the function of temperature control valve 81 in FIG. 2 is to open after all of temperature responsive control valves 55, 57, 59 and 61 have closed due to excessive load demands. In this manner the available hot or warm water (below 105°F) will be provided to all of the loads from hot water heaters 31, 33, 35 and 37, even though the system is overloaded and temperature responsive valves 55, 57, 59 and 61 are closed.

What is claimed:

1. A parallel fluid heating system comprising:

a. at least first and second fluid heaters;

b. at least one load that consumes heated fluid;

c. at least first and second cold fluid inlet conduits respectively connected to the inlets of said at least first and second fluid heaters;

d. at least first and second hot fluid outlet conduits respectively connected to the outlets of said first and second fluid heaters;

e. said at least first and second hot fluid outlet conduits being connected to said at least one load;

f. at least first and second temperature responsive control valves respectively positioned in said at least first and second hot fluid outlet conduits for respectively controlling the hot fluid flow rate therein in response to the temperature of the hot fluid contained therein; and g. each of said at least first and second temperature responsive control valves are open when said fluid temperature is above a first predetermined value and closed when said fluid is below a second predetermined value and said first predetermined value being greater than said second predetermined value.

2. The system of claim 1 wherein:

a. each of said at least first and second temperature responsive control valves vary from fully closed to fully open by an amount that is about linearly proportional to an increase in fluid temperature.

3. The system of claim 1 wherein:

a. said first predetermined value is about 130°F and said second predetermined value is about 105°F.

4. The system of claim 1 wherein:

a. each of said at least first and second temperature responsive control valves vary from fully closed to fully open by an amount that increases about exponentially with an increase in fluid temperature.

5. The system of claim 1 wherein:

a. said first hot fluid outlet conduit is longer than said second hot fluid outlet conduit.

6. The system of claim 1 wherein:

a. said at least one load comprising at least first and second loads; and b. all of said at least first and second hot fluid outlet conduits being connected in parallel to all of said at least first and second loads.

7. The system of claim 1 including:

a. a by-pass conduit connected between the outlet of each of said at least first and second fluid heaters and said at least one load;

b. a by-pass valve positioned in said by-pass conduit; and c. said by-pass valve opening when all of said at least first and second temperature responsive valves are closed and closing when any one of said at least first and second temperature responsive valves are open.

* * * * *